US005109422A

United States Patent [19]

Furukawa

[11] Patent Number: 5,109,422

[45] Date of Patent: Apr. 28, 1992

[54] ACOUSTIC APPARATUS

[75] Inventor: Kazunari Furukawa, Hamamatsu, Japan

[73] Assignee: Yamaha Corporation, Hamamatsu, Japan

[21] Appl. No.: 413,381

[22] Filed: Sep. 27, 1989

[30] Foreign Application Priority Data

Sep. 28, 1988 [JP] Japan ..... 63-125629
Sep. 28, 1988 [JP] Japan ..... 63-125630
Sep. 28, 1988 [JP] Japan ..... 63-125631

[51] Int. Cl.[5] ..... H04R 3/00

[52] U.S. Cl. ..... 381/96; 381/159; 381/188; 381/90; 181/160; 181/199

[58] Field of Search ..... 381/88, 89, 96, 90, 381/159, 158, 189, 205, 188; 181/150, 146, 155, 160, 175, 184, 199

[56] References Cited

U.S. PATENT DOCUMENTS 4,126,204 11/1978 Ogi et al. ..... 181/156
4,135,600 1/1979 Ogi et al. ..... 181/156
4,146,744 3/1979 Veranth ..... 381/89
4,624,337 11/1986 Shavers ..... 381/90

FOREIGN PATENT DOCUMENTS 1110228 7/1961 Fed. Rep. of Germany .
2362547 3/1978 France .
2403706 4/1979 France .
2433268 3/1980 France .
0588661 1/1978 U.S.S.R. .

OTHER PUBLICATIONS

"B&W 801 Matrix Series 2 Professional Monitor Loudspeaker" by Lewis Lipnick, A reprint from Stereophile, vol. 10, No. 9, Dec. 1987.

*Primary Examiner*—Forester W. Isen
*Attorney, Agent, or Firm*—Spensley Horn Jubas & Lubitz

[57] ABSTRACT

An acoustic apparatus comprises a Helmholtz resonator which has a cavity and an open duct port for causing the cavity to communicate with an external region thereof and a vibrator which is arranged in the resonator to drive the resonator. In a first aspect, the open duct port comprises an air permeable member having a proper acoustic resistance and a viscoelastic member having no air permeability so that noise caused by an open duct resonant, wind noise, turbulence or the like is prevented. In a second aspect, a viscoelastic member is disposed at the mounting portion between the open duct port and a cabinet defining the cavity so that transmission to the cabinet of derivative vibration causing at the open duct port is prevented. In a third aspect, the portion, opposite to the open duct port, of an ornament grille attached to the front surface of the acoustic apparatus is given a larger air permeability than other portions of the grille so that wind noise when the grille is attached before the open duct port is prevented. Thus, noise generated when the resonator is driven is prevented or eliminated and distortion characteristics of the apparatus are improved.

8 Claims, 9 Drawing Sheets

ACOUSTIC APPARATUS

BACKGROUND OF THE INVENTION

1. Field of the Invention

The present invention relates to an acoustic apparatus in which a vibrator is arranged in a Helmholtz resonator having an open duct port, and is driven to drive the resonator to radiate a resonant sound and, more particularly, to an acoustic apparatus in which a resonant sound other than a Helmholtz resonant sound and noise generated when a Helmholtz resonator is driven is eliminated and distortion characteristics are improved.

2. Description of the Prior Art

As an acoustic apparatus utilizing a Helmholtz resonance, a phase-inversion type (bass-reflex type) speaker system is known. FIGS. 7A and 7B are respectively a perspective view and a sectional view showing an arrangement of the bass-reflex speaker system. In the speaker system shown in FIGS. 7A and 7B, a hole is formed in the front surface of a cabinet 701, a vibrator (dynamic speaker unit) 704 consisting of a diaphragm 702 and a dynamic speaker 703 is mounted in the hole, and an open duct port 706 having a sound path 705 is formed therebelow. In the bass-reflex speaker system according to the conventional basic design, a resonance frequency (antiresonance frequency) $f_{OP}$ defined by an air spring of the cabinet 701 and an air mass in the sound path 705 is set to be lower than the lowest resonance frequency $f_{OC}$ of the vibrator 704 when the vibrator 704 is assembled in the cabinet 701 of bass-reflex type, and, in some cases, than the lowest resonance frequency $f_O$ inherent in the vibrator. At a frequency higher than the antiresonance frequency $f_{OP}$, the phase of the sound pressure from the rear surface of the diaphragm 702 is inverted at the sound path 705. Consequently, in front of the cabinet 701, a sound directly radiated from the front surface of the diaphragm 702 is in-phase with a sound from a port opening portion 707, and these sounds are in-phase added to each other, thus increasing the sound pressure. As a result of the in-phase addition, the lowest resonance frequency of the system is expanded to the antiresonance frequency $f_{OP}$ of the resonator, and according to an optimally designed bass-reflex speaker system, the frequency characteristics of the output sound pressure can be expanded to the resonance frequencies $f_{OC}$ and $f_O$ of the vibrator or less. As indicated by an alternate long and two short dashed curve in FIG. 8, a uniform reproduction range can be widened as compared to an infinite plane baffle or closed baffle.

However, in the bass-reflex type speaker system, an open duct resonance, wind noise, turbulence, or the like occurs at the open duct port, and the resonant sound or wind noise are radiated as noise or a distortion component of an acoustic sound, or a radiated acoustic sound is distorted by the turbulence.

In order to eliminate such distortion or noise, another acoustic apparatus wherein a small-diameter portion is formed in the central portion of a port to eliminate port resonance has been proposed (Japanese Utility Model Publication No. sho 54-35068). However, in this case, as the diameter of the small-diameter portion is decreased to enhance a filter effect, an acoustic resistance of the port is increased, and the Q value of the Helmholtz resonance is decreased. As a result, the behavior of the speaker system approximates an operation of a closed type speaker system, and its frequency characteristics approximate those indicated by an alternate long and short dashed curve in FIG. 8. Therefore, bass-sound radiation power is decreased.

The conventional open duct port is formed of a relatively hard material such as paper or plastic. For this reason, an airflow collides against the edge portion of the open duct port member at a portion where an airflow passing through the open duct port cannot become uniform (to be referred to as a boundary condition abrupt change portion hereinafter), e.g., the small-diameter portion or openings at two ends of the open duct port, thus causing wind noise or turbulence. The wind noise is directly radiated as noise or acoustic distortion, and the turbulence induces a nonuniformity of an acoustic radiation resistance over time, thus distorting a radiated acoustic sound.

FIG. 9 shows an arrangement of an acoustic apparatus (speaker system with a resonance port) shown in U.S. patent application No. 07/286,869 which was assigned to the same assignee as that of the present application. In the acoustic apparatus shown in FIG. 9, the resonance frequency $f_{OP}$ of a Helmholtz resonator is set to be still lower than that of a conventional bass-reflex speaker system shown in FIGS. 7A and 7B, and a vibrator for driving the Helmholtz resonator is driven to cancel an air counteraction from the resonator when the vibrator for driving the resonator is driven, thus realizing a compact acoustic apparatus which can perform lower bass sound reproduction.

The above-mentioned noise such as a duct resonant sound or wind noise is present in a conventional bass-reflex speaker system. However, such noise is conspicuous in the speaker system with the resonance port, which very strongly drives and damps the vibrator 104, as shown in FIG. 9.

In general, an ornament grille is attached to the front surface of a speaker system. FIGS. 10A and 10B are sectional views of an open duct port and a grille portion in the conventional speaker system. As shown in FIGS. 10A and 10B, an open duct port 1006 made of paper or plastic is buried in a baffle surface 1001*a* or is mounted thereon from the rear surface side. An ornament grille 1009 of, e.g., a SARAN grille cloth, metal net, punching metal, or the like is attached in front of the baffle surface 1001*a*.

However, in the speaker system with the resonance port in the prior application, when the grille is attached to its front surface, noise is generated by wind noise caused by a high-speed airflow from the open duct port or vibration of the grille. In particular, in the grille of punching metal or metal net, noise caused by vibration tends to be easily generated. When an airflow passes through holes of the punching metal or meshes of the metal net, wind noise is also generated. Note that such wind noise is especially conspicuous in the speaker system with the resonance port shown in FIG. 9. In the acoustic apparatus having the open duct port, e.g., the speaker system with the resonance port, the conventional bass-reflex speaker system, or the like, such a problem is inevitably posed more or less regardless of the types of apparatus.

SUMMARY OF THE INVENTION

The present invention has been made in consideration of the conventional problems, and has as its first object to provide an acoustic apparatus in which a vibrator is arranged in a Helmholtz resonator having an open duct port, and which can eliminate, prevent, or remove unnecessary duct resonant sound, wind noise, turbulence, or the like caused when the Helmholtz resonator is driven without impairing the Q value of the Helmholtz resonator and, hence, the lower bass tone reproduction performance of the acoustic apparatus comprising the Helmholtz resonator as much as possible, and can improve noise characteristics and distortion characteristics.

It is a second object of the present invention to provide an acoustic apparatus using a Helmholtz resonator having an open duct port, which can eliminate noise when an ornament grille is attached thereto.

In order to achieve the first object, according to a first aspect of the present invention, the open duct port of the Helmholtz resonator is constituted by an air permeable member having a proper acoustic resistance, and a viscoelastic member attached to the air permeable member.

Examples of the material of the air permeable member having an acoustic resistance are felt, sponge, nonwoven fabric, woven fabric, and the like.

An example of a material of a flexible member having viscoelasticity is rubber, or the like.

According to the first aspect, the air permeable member having a proper acoustic resistance serves as a sound absorption member on the inner surface of the open duct port, and prevents generation of duct resonance and wind noise. As a result, the duct resonance and wind noise can hardly be generated.

When the central portion of the open duct port is exposed as an outer wall surface as the air permeable member, a pressure at a speed node (antinode of the pressure) of duct resonance is relaxed by air permeability of the exposed portion. As a result, the duct resonance can hardly occur.

Furthermore, the viscoelastic member attached to the air permeable member controls the air permeability of the air permeable member to appropriately suppress a decrease in Q value as the resonance port, and damps derivative vibration of the port itself derived from the wind noise or the like to suppress noise caused by the derivative vibration.

According to the first aspect, since duct resonance, wind noise, and turbulence which are not necessary for the Helmholtz resonator are suppressed, as described above, radiation of an open duct resonant sound as a noise or distortion component of the acoustic apparatus using the Helmholtz resonator can be eliminated or prevented.

Since use of a relatively hard material such as paper or plastic in the open duct port is eliminated, the derivative vibration of the port itself is damped, and noise caused by the derivative vibration is reduced or prevented.

Since the diameter of the open duct port need not be extremely decreased and the air permeability from the port side wall is controlled by the viscoelastic member, a sufficiently high Q value of the Helmholtz resonance can be maintained.

According to a second aspect of the present invention, in an acoustic apparatus in which a vibrator is arranged in a Helmholtz resonator, a viscoelastic member is inserted at a mounting portion between an open duct port and a cavity constituting the Helmholtz resonator.

In a conventional acoustic apparatus utilizing a Helmholtz resonator, an open duct port 1106 formed of a relatively hard material such as paper or a resin is directly adhered to a baffle surface 1101*a* of a cabinet 1101, as shown in FIG. 11A or 11B, or is mounted thereon through an ornament mounting member of a hard resin, as shown in FIG. 11C. Therefore, when vibration of the duct itself or derivative vibration such as open duct resonance or wind noise occurs at the open duct port 1106, since the open duct port 1106 is in hard contact with the baffle surface 1101*a*, derivative vibration at the open duct port 1106 is transmitted to the cabinet 1101, and is radiated from the cabinet 1101, thus generating noise or degrading distortion characteristics of the Helmholtz resonant sound.

In the second aspect of the present invention, as described above, a viscoelastic member having an anti-vibration effect is inserted at the mounting portion between the baffle surface 1101*a* of the cabinet 1101 as a cavity and the open duct port 1106. Therefore, the derivative vibration of the open duct port 1106 cannot be easily transmitted to the cabinet 1101.

Therefore, unnecessary noise radiation from the cabinet 1101 can be eliminated or prevented, and noise is eliminated as a whole, thus improving distortion characteristics.

According to the second aspect, the viscoelastic member is elastically deformable. Thus, when an opening is formed in the baffle surface and the open duct port is fitted in the opening, the open duct port can be in tight contact with the baffle opening, and can be clamped thereby, thus facilitating a mounting operation.

In order to achieve the second object, according to a third aspect of the present invention, in an acoustic apparatus in which a vibrator is arranged in a Helmholtz resonator having an open duct port, air permeability of a portion, facing the opening portion of the open duct port, of the ornament grille attached to the acoustic apparatus is increased as compared to other portions.

An outlet airflow passing the open duct port is linearly delivered from the opening portion of the open duct port. An inlet airflow is gathered at the open duct port to dangle around the port mounting surface (baffle surface), and flows in along the inner edge of the open duct port. For this reason, if there is an obstacle in front of the opening portion of the open duct port, the airflow linearly delivered from the open duct port collides against the obstacle to generate wind noise or the obstacle vibrates to generate vibration noise. In the third aspect, when an ornament grille is attached, a portion as an obstacle of the outlet airflow is removed or its degree of obstacle is decreased, so that the outlet airflow can be prevented from collision as much as possible.

Thus, noise such as wind noise or vibration noise generated when the outlet airflow from the open duct port collides against the obstacle can be prevented or eliminated. Thus, when an ornament grille is attached, an acoustic apparatus which is free from noise can be provided.

DESCRIPTION OF THE PREFERRED EMBODIMENTS

Figure 9:
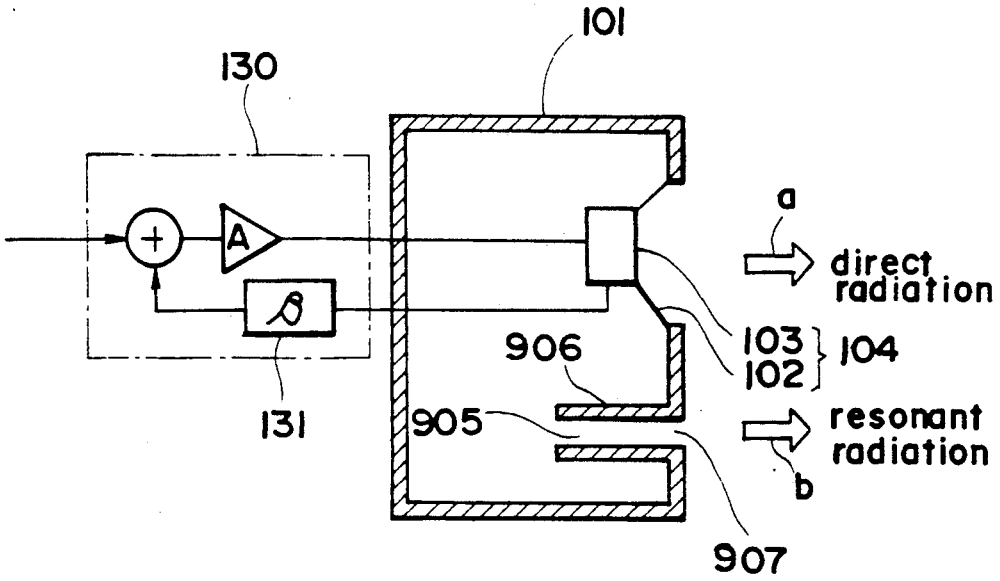
FIG. 9 is a sectional view showing a basic arrangement of an acoustic apparatus according to the prior application of the present applicant.
Figure 10A:
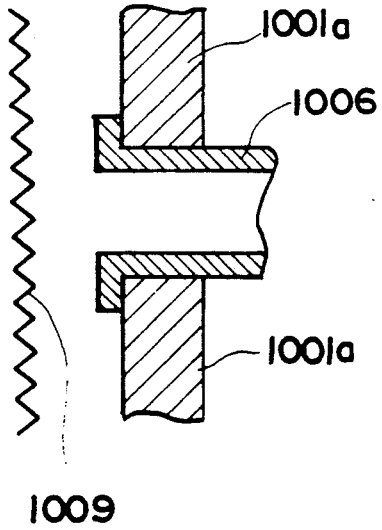
(Prior art) FIG. 10A
FIGS. 10A and 10B are sectional views showing mounting structures of an open duct port and a cabinet of the conventional acoustic apparatus, respectively.
Figure 10B:
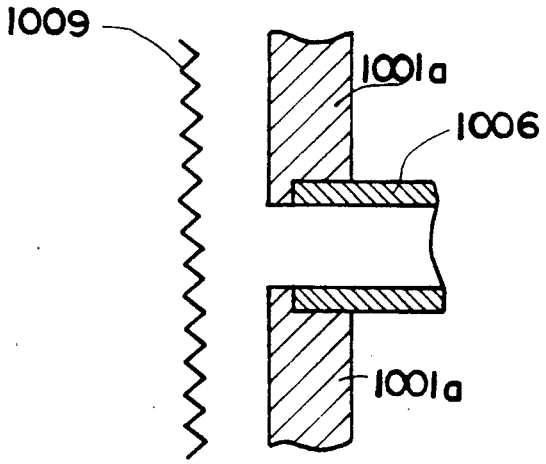
(Prior art) FIG. 10B
Figure 11A:
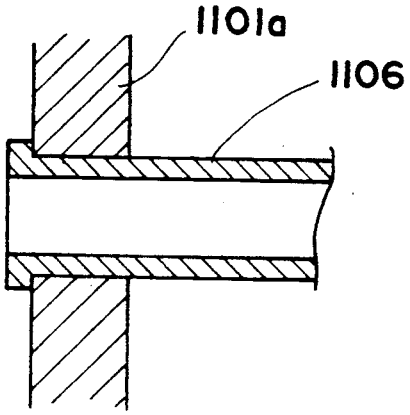
( Prior art ) FIG. 11A
FIGS. 11A, 11B, and 11C are sectional views showing mounting structures of an open duct port and a cabinet of the conventional acoustic apparatus, respectively.
Figure 11B:
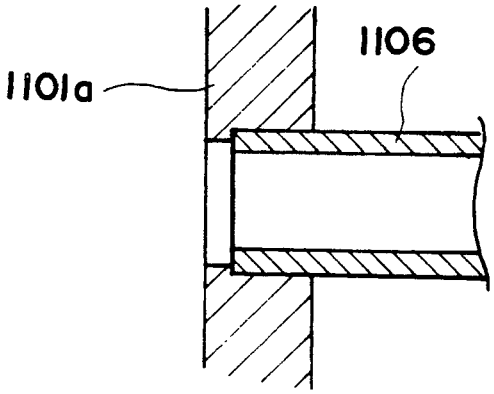
( Prior art) FIG. 11B
Figure 11C:
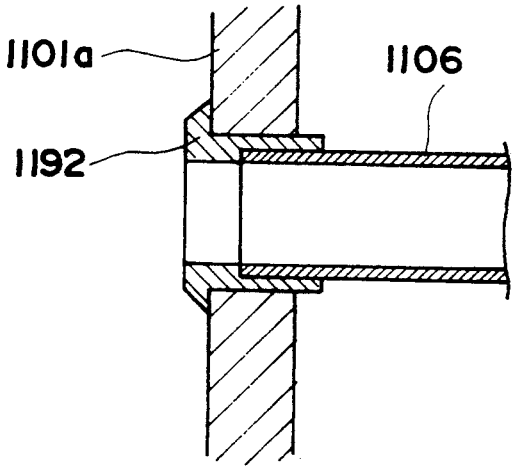
( Prior art ) FIG. 11C

Preferred embodiments of the present invention will now be described with reference to FIGS. 1 to 6B. The same reference numerals denote common or corresponding parts shown in FIG. 9.

Description of Basic Arrangement of Embodiment

Figure 1:
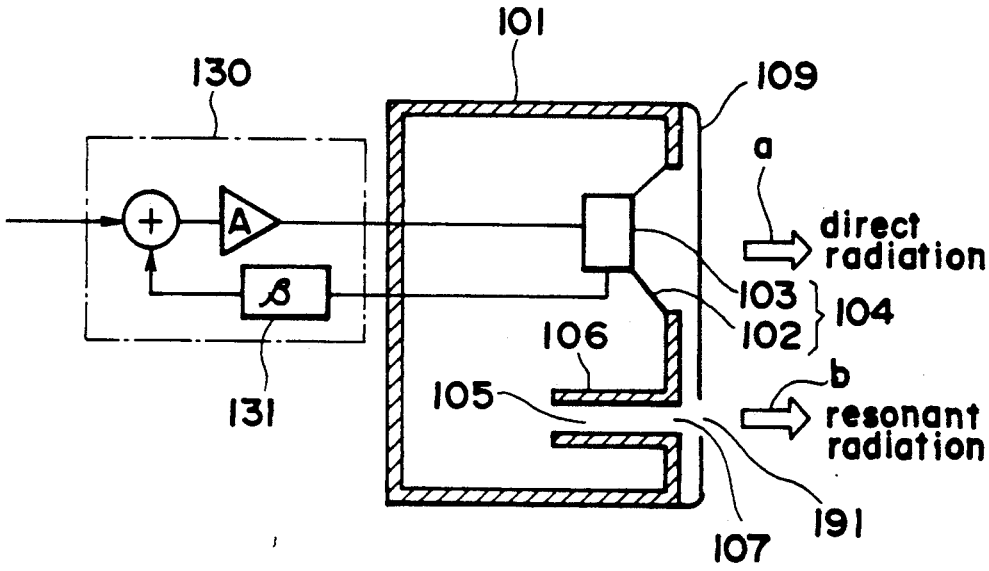
FIG. 1 is a sectional view of a basic arrangement of an embodiment of an acoustic apparatus according to the present invention.

FIG. 1 shows a basic arrangement of an embodiment of an acoustic apparatus according to the present invention shown in FIGS. 1 to 6B. In an acoustic apparatus (speaker system) shown in FIG. 1, a hole is formed in the front surface of a cabinet 101, and a vibrator 104 consisting of a diaphragm 102 and a dynamic electro-acoustic transducer (speaker) 103 is mounted in the hole. An open duct port 106 which has a sound path 105 whose opening port is open to an external portion of the cabinet 101 is arranged below the vibrator 104. The open duct port 106 and the cabinet 101 form a Helmholtz resonator. In the Helmholtz resonator, an air resonance phenomenon is caused by an air spring of the cabinet 101 as a closed cavity and an air mass in the sound path 105 of the open duct port 106. The resonance frequency $f_{OP}$ is given by:

$$f_{OP}=c(S/lV)^{\frac{1}{2}}/2\pi \quad (1)$$

where c is the velocity of sound, S is the sectional area of the sound path 105, l is the length of neck of the open duct port 106, and V is the volume of the cabinet 101.

In the acoustic apparatus, an ornament grille 109 having a hole portion 191 at a position opposing an opening portion 107 of the open duct port 106 is often attached to the front surface of the cabinet 101. In FIG. 1, the ornament grille 109 which improves air permeability of the portion 191 opposing the opening portion 107 of the open duct port 106 is attached to the front surface of the cabinet 101. In embodiments to be described below, the portion 191 is described as a structure whose air permeability is maximized, i.e., a complete hole portion. However, a structure in which a hole portion is equivalently formed, i.e., a structure in which meshes of the portion 191 are more coarse than other portions, or a diameter of each punching hole is larger than that of other portions may be employed, as a matter of course.

In the acoustic apparatus of this embodiment, the transducer 103 of the vibrator 104 is connected to a vibrator driver 130. The vibrator driver 130 comprises a servo unit 131 for performing an electrical servo so as to cancel an air counteraction from the resonator when the Helmholtz resonator constituted by the cabinet 101 and the open duct port 106 is driven. As the servo system, a known circuit, such as a negative resistance generator for equivalently generating a negative resistance component ($-R_0$) in an output impedance to cancel the voice coil resistance of the transducer 103, a motional feedback (MFB) circuit for detecting a motional signal corresponding to the behavior of the diaphragm 102 of the vibrator 104 and negatively feeding back the signal to the input side by a proper means, or the like may be employed.

The operation of the acoustic apparatus with the arrangement shown in FIG. 1 will be described.

When a drive signal is supplied from the vibrator driver 130 to the transducer 103 of the vibrator 104, the transducer 103 electro-mechanically converts the drive signal to reciprocate the diaphragm 102 in the back-and-forth direction (right-and-left direction in FIG. 1). The diaphragm 102 mechano-acoustically converts the reciprocal movement. The front surface side (right surface side in FIG. 1) of the diaphragm 102 constitutes a direct radiation portion for directly externally radiating an acoustic wave, and the rear surface side (left surface side in FIG. 1) of the diaphragm 102 constitutes a resonator driving portion for driving the Helmholtz resonator constituted by the cabinet 101 and the open duct port 106. Although an air counteraction from the air in the cabinet 101 acts on the rear surface side of the diaphragm 102, the vibrator driver 130 drives the vibrator 104 to cancel the air counteraction.

In this manner, since the vibrator 104 is driven to cancel the air counteraction from the resonator when the Helmholtz resonator is driven, the diaphragm 102 cannot be driven from the side of the resonator, and serves as a rigid body, i.e., a wall. Therefore, the resonance frequency and the Q value of the Helmholtz resonator are independent from those of the diaphragm 102 of the vibrator 104 as the direct radiation portion, and the resonator drive energy from the vibrator 104 is given independently of the direct radiation portion. Since the vibrator 104 is driven in a so-called "dead" state wherein it is not influenced by the air counteraction from the resonator, i.e., the cabinet 101, the frequency characteristics of a directly radiated acoustic wave are not influenced by the volume of the cabinet 101. Therefore, according to the arrangement of this embodiment, the volume of the cabinet 101 as the cavity of the Helmholtz resonator can be reduced as compared to a conventional bass-reflex type speaker system. In this case, if the resonance frequency $f_{OP}$ is set to be lower than that of the conventional bass-reflex type speaker system, a sufficiently high Q value can be set. As a result, in the acoustic apparatus shown in FIG. 1, if the cabinet 101 is reduced in size as compared to the conventional bass-reflex type speaker system, reproduction of lower bass sounds can be performed.

When, e.g., a circuit for generating a negative resistance ($-R_0$) whose absolute value is equal to the voice coil resistance of the vibrator 104 is employed as the servo system 131, so that the vibrator 104 is driven to completely cancel an air counteraction from the resonator when the Helmholtz resonator is driven, the resonance frequency and Q value of the Helmholtz resonator are independent from those of the diaphragm 102 of the vibrator 104 as the direct radiation portion. In this case, the Helmholtz resonator is present as a virtual speaker which performs acoustic radiation quite independently of the vibrator 104. Although the virtual speaker is realized by a small diameter corresponding to the port diameter, it corresponds to one having a considerably large diameter in terms of its lower bass tone reproduction performance.

Figure 2:
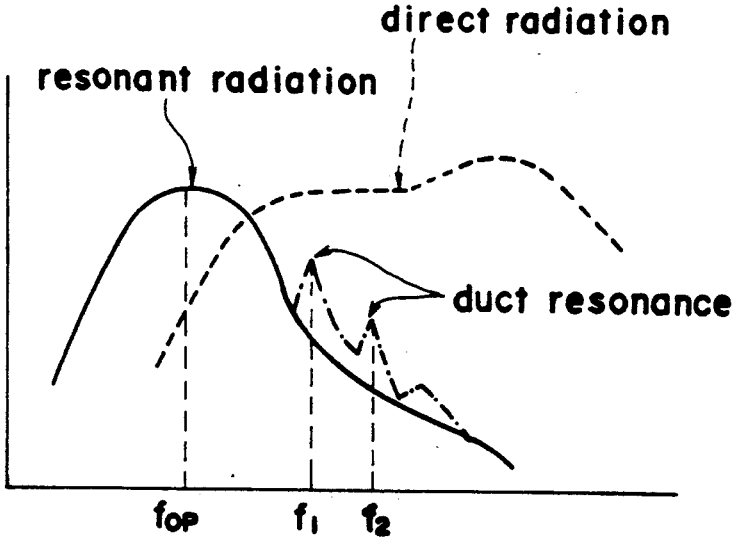
FIG. 2 is a graph showing frequency characteristics of a sound pressure of an acoustic sound radiated from the acoustic apparatus shown in FIG. 1.

In FIG. 1, the transducer 103 of the vibrator 104 drives the diaphragm 102 in response to the drive signal from the vibrator driver 130, and independently supplies drive energy to the Helmholtz resonator constituted by the cabinet 101 and the open duct port 106. Thus, an acoustic wave is directly radiated from the diaphragm 102 as indicated by an arrow a in FIG. 1. At the same time, air in the cabinet 101 is resonated, and an acoustic wave having a sufficient sound pressure can be resonantly radiated from the resonance radiation portion (port opening portion 107 of the open duct port 106) as indicated by an arrow b in FIG. 1. By adjusting an air equivalent mass in the open duct port 106 in the Helmholtz resonator, the resonance frequency $f_{OP}$ is set to be lower than a reproduction frequency range of the transducer 103, and by adjusting an equivalent resistance of the open duct port 106 to set the Q value to be an optimal level, a sound pressure of a proper level can be obtained from the port opening portion 107. Under these conditions, the frequency characteristics of a sound pressure shown in, e.g., FIG. 2 can be obtained. In FIG. 2, a solid curve represents frequency characteristics of an acoustic sound pressure resonantly radiated from the port opening portion 107, and a broken curve represents an acoustic sound pressure directly radiated from the diaphragm 102 of the vibrator 104.

In the acoustic apparatus described above, the open duct port 106 is formed to have a smaller diameter and larger length than those of a conventional bass-reflex speaker system, and a faster airflow passes therethrough. For this reason, when the open duct port 106 is formed of a relatively hard material such as plastic or wood, the open duct port 106 is open-duct resonated by an air flow passing therethrough caused by Helmholtz resonance, and an acoustic wave having the following frequencies caused by the open duct resonance is radiated, as indicated by an alternate long and short dashed curve in FIG. 2:

$$f_1 = c/2l_1 \quad (2)$$

$$f_2 = c/4l_1 \quad (3)$$

The radiated acoustic wave is mixed in the resonantly radiated acoustic wave of the Helmholtz resonator as a distortion or noise component. A turbulence is produced at a boundary condition abrupt change portion such as the port opening portion 107, wind noise is generated at the edge portion of the open duct port member, or the open duct port itself is vibrated. Such derivative vibration such as duct resonance, wind noise, vibration, or the like is transmitted to the cabinet 101, and is radiated therefrom as a distortion component.

In order to prevent the open duct resonance, a small-diameter portion is formed in the open duct port 106, as shown in Japanese Utility Model Publication No. sho 54-35068, or a plurality of holes are formed in the central portion of the open duct port along its circumferential direction. In these cases, however, wind noise or turbulence occurs at the small-diameter portion or the edge portions of the holes.

In these acoustic apparatuses, when the same ornament grille with no hole portion 191 as in the conventional speaker system, unlike the grille 109 shown in FIG. 1, is attached to the front surface of the cabinet 101, noise such as vibration noise of the ornament grille or wind noise is generated by an airflow, especially, an outlet airflow passing through the open duct port 106.

The above problem is also posed when a vibrator (speaker unit) of a conventional bass-reflex speaker system is constant-voltage driven by a conventional power amplifier. When the vibrator 104 is driven to cancel an air counteraction from the Helmholtz resonator to improve the Q value of the Helmholtz resonator and to improve a sound pressure of resonant radiation, the above problem is conspicuous since an airflow passes through the open duct port at a very high speed.

First Embodiment

Figure 3A:
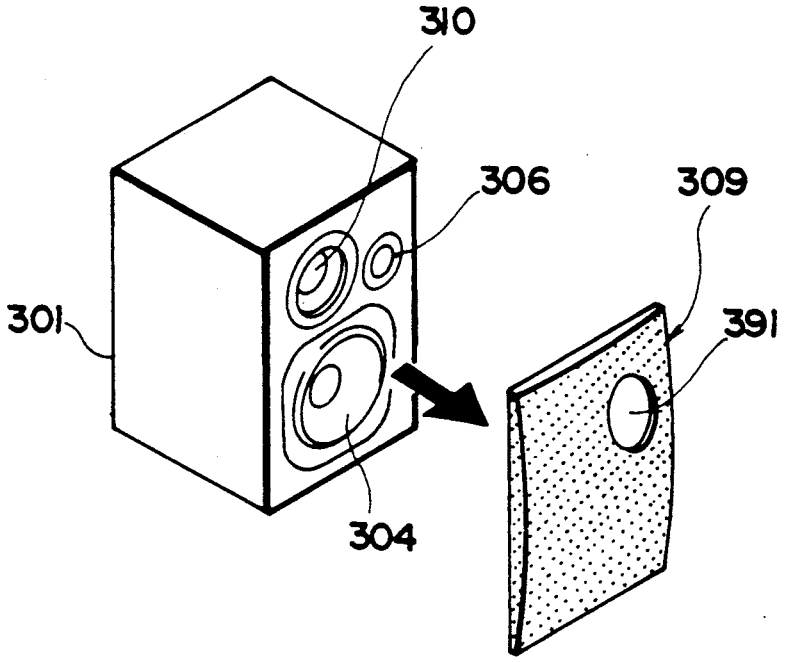
FIGS. 3A, 3B, and 3C are respectively a perspective view of an acoustic apparatus according to a first embodiment of the present invention, an enlarged sectional view of the main part of the apparatus, and a perspective view of an open duct port.
Figure 3B:
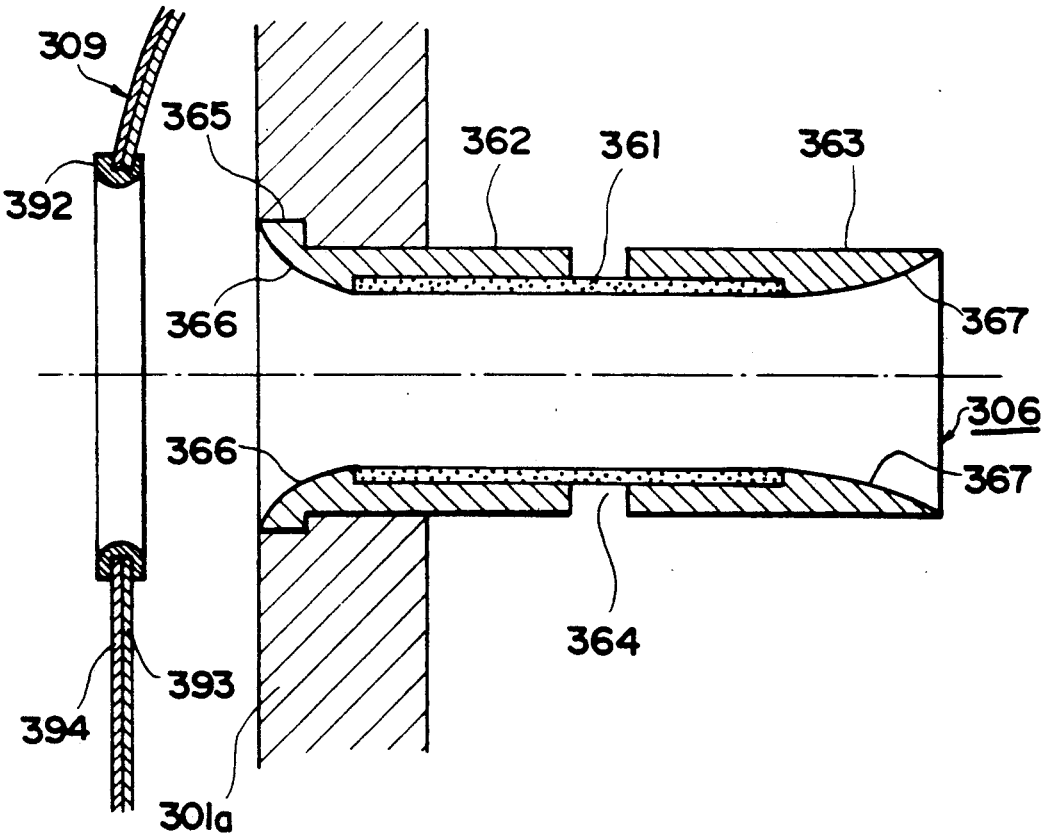
Figure 3C:
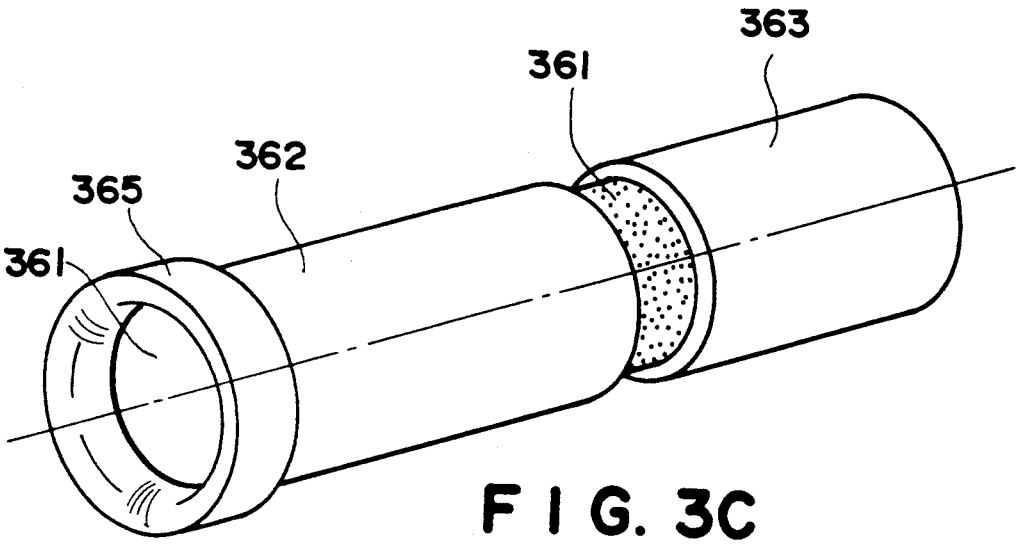

FIGS. 3A to 3C are respectively a perspective view of an acoustic apparatus according to a first embodiment of the present invention, an enlarged sectional view of the main part of the apparatus, and a perspective view of an open duct port.

In the acoustic apparatus shown in FIGS. 3A to 3C, the present invention is applied to a 2-way speaker system constituted by a tweeter 310 and a squawker 304. An open duct port 306 comprises an assembly having a structure in which outer cylinders 362 and 363 of rubber (SBR of hardness 50) are fitted around an inner cylinder (core member) 361 of 1-mm thick felt. The inner cylinder 361 and the outer cylinders 362 and 363 need only be elastically fitted. In this embodiment, the inner cylinder 361 and the outer cylinders 362 and 363 are adhered by a rubber-based adhesive. The open duct port assembly 306 is designed to have an effective port length of about 150 mm and an effective port diameter of about 35 mm as a whole. When this assembly 306 is combined with a cabinet 301 having a volume of 6 l, the Helmholtz resonance frequency given by equation (1) is about 40 Hz. A gap 364 having a width of about 5 mm is formed between the outer cylinders 362 and 363. Thus, at the central portion of the open duct port assembly 306, the felt inner cylinder 361 is exposed from the outer peripheral wall surface of the open duct port in a slit form having a width of about 5 mm along the circumferential direction of the assembly. The outer cylinder 362 extends from the front edge of the inner cylinder 361, and a flange 365 is formed at its distal end. In this acoustic apparatus, the open duct port assembly 306 constituted by the inner cylinder 361 and the outer cylinders 362 and 363 is inserted in a baffle surface 301*a* of the cabinet 301 from the front surface side, and is aligned such that the flange 365 of the outer cylinder 362 abuts against the baffle surface 301*a*. The outer cylinder 362 and the baffle surface 301*a* are fixed by elastic fitting or an adhesive.

An ornament grille 309 attached to the front surface of the cabinet 301 has a hole portion 391 at a position facing and in front of an opening portion 307 of the open duct port assembly 306. An escutecheon (ring member) 392 made of a resin is fitted in the hole portion 391. The distal end portion of the outer cylinder 362 is formed to expand into a horn-like (or morning glory) shape by an R (radial) surface 366. The outer cylinder 363 extends to the rear edge side of the inner cylinder 361. The extending portion of the outer cylinder 393 is formed to smoothly expand by an R surface 367. In this embodiment, the ornament grille 309 has a structure in which a SARAN grille cloth 394 is adhered to the surface of a punching metal member 393 molded into a predetermined shape.

In this acoustic apparatus, at nodes of a speed of open duct resonance of the open duct port assembly 306, i.e., at antinodes of a pressure, low and high air densities upon resonance appear at resonance frequencies. However, the air density cannot become sufficiently high or low due to air permeability of the exposed portion of the felt inner cylinder 361 at the gap 364 between the outer cylinders formed at the central portion of the open duct port assembly 306. Thus, open duct resonance is difficult to occur. Since the felt surface as the inner surface of the open duct port assembly 306 has a properly large resistance against air movement, open duct resonant energy is absorbed and is converted to heat, and its level is decreased. The inner surface of the open duct port does not serve as a stationary wall due to flexibility of the felt inner cylinder and the rubber outer cylinders but serves as a passive vibrator, thus absorbing an acoustic wave caused by duct resonance of the open duct port. Since the boundary condition abrupt change portions at the two ends of the open duct port assembly 306 are formed of rubber having viscoelasticity, generation of turbulence and wind noise at these abrupt change portions can be suppressed. Since these abrupt change portions are formed as R surfaces, a change in boundary condition is relaxed, so that the turbulence and wind noise are further effectively suppressed.

As a result, open duct resonance frequencies appearing as peaks at frequencies $f_1$ and $f_2$ in FIG. 2, i.e., noise or distortion components caused by open duct resonance can be remarkably eliminated or removed.

In this acoustic apparatus, a countermeasure for preventing or eliminating other noise components is also taken. For example, in this acoustic apparatus, since the inner cylinder 361 as the main body of the open duct port and the cabinet 301 are coupled through the outer cylinder 362 as a viscoelastic member, they can enjoy an anti-vibration effect. Even if derivative vibration such as wind noise or duct resonance occurs at the open duct port main body 361, it can hardly be transmitted to the cabinet 301, and unnecessary acoustic wave (noise) from the cabinet can be eliminated. Thus, noise characteristics and distortion characteristics of the acoustic apparatus can be improved.

Since the outer cylinder 362 interposed between the open duct port main body 361 and the cabinet 301 is a viscoelastic member, it is elastically deformed upon mounting, so that the open duct port can be in tight contact with the opening for mounting the open duct port of the baffle surface 301*a* to be clamped thereby, thus facilitating a mounting operation.

In a mounting operation, the outer cylinder 362 and the open duct port mounting opening can be perfectly fixed by adhesion without impairing the anti-vibration effect. Alternatively, they can be mounted by a self elastic force of the outer cylinder 362 as the viscoelastic member without using an adhesive.

In this acoustic apparatus, although an airflow from the open duct port 306 is linearly delivered, a portion of the ornament grill 309 located in front of the opening portion 307 of the open duct port 306 is removed to form the hole portion 391 having large air permeability. Therefore, the hole portion 391 does not serve as an obstacle with respect to the delivered airflow, and vibration noise or wind noise of the ornament grille caused by collision of the delivered airflow against the ornament grille in the conventional system can be prevented.

Second Embodiment

Figure 4A:
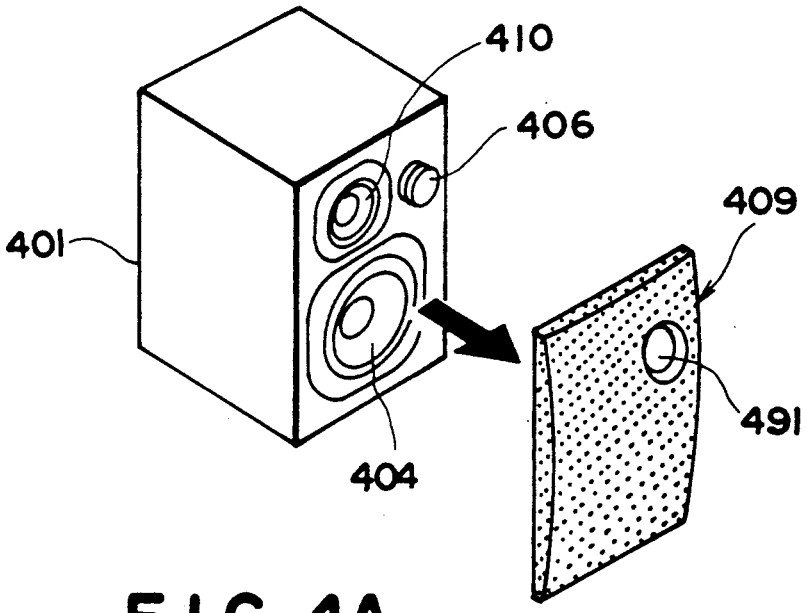
FIGS. 4A, 4B, and 4C are respectively a perspective view of an acoustic apparatus according to a second embodiment of the present invention, an enlarged sectional view of the main part of the apparatus, and a perspective view of an open duct port.
Figure 4B:
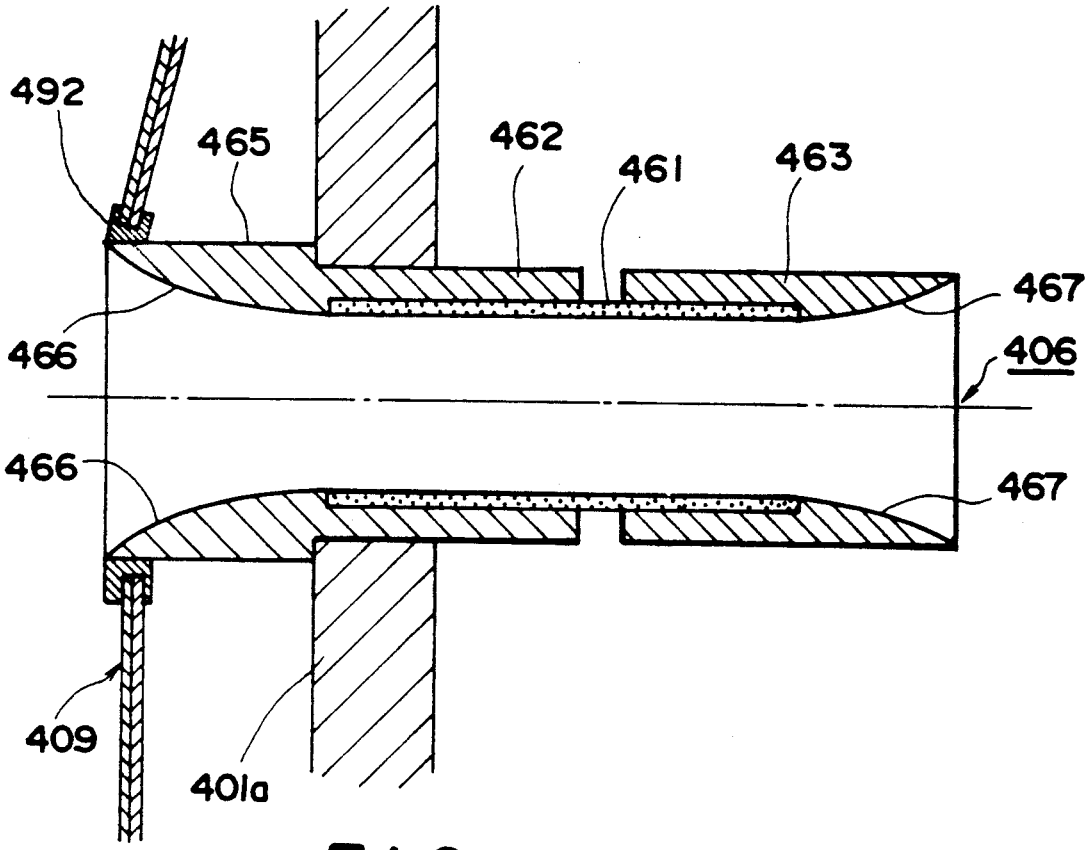
Figure 4C:
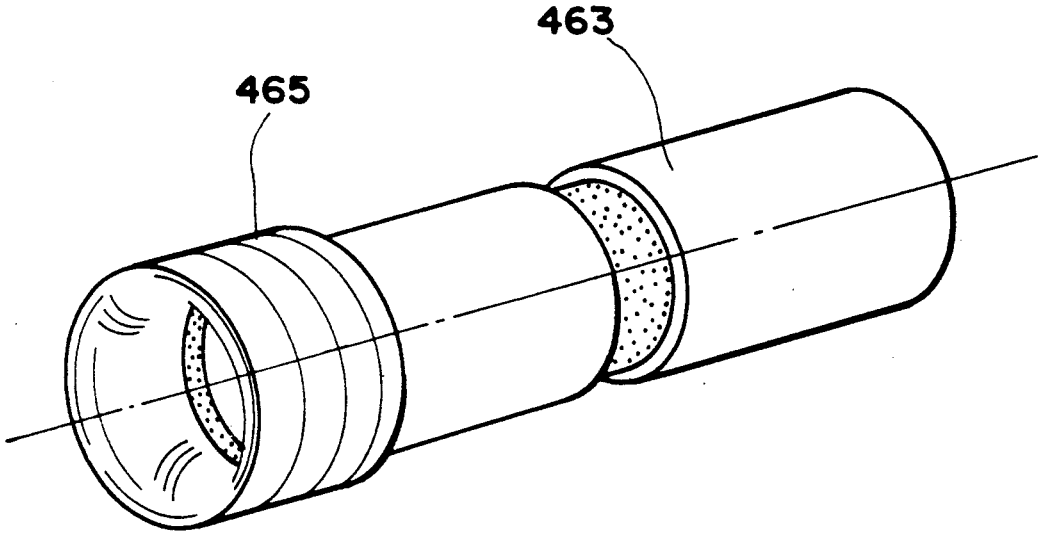

FIGS. 4A to 4C show a second embodiment of the present invention.

In the acoustic apparatus shown in FIGS. 4A to 4C, the outer cylinder 362 in the first embodiment shown in FIGS. 3A to 3C is modified. More specifically, a rubber outer cylinder 462 has a flange 465 portion which extends forward by a larger distance than in the first embodiment. The distal end of the flange is inserted in a hole portion 491 formed in an ornament grille 409 when the grille 409 is attached to the front surface of the speaker system, and reaches a position at the same level as the outer side surface of the grille 409 to be elastically fitted in a resin escutecheon 492 fitted in the hole portion 491. Since the distal end portion of the outer cylinder 462 has a longer extending portion than that in the first embodiment, an inner R surface 466 is formed to expand more slowly than in the first embodiment. As a result, in the acoustic apparatus shown in FIG. 4A to 4C, when the ornament grille 409 shown in FIG. 4A is detached, an open duct port 406 extends from a baffle surface 401*a* of a cabinet 401 by a 30 to 35 mm. Other portions have the same arrangement as those denoted by the same lower two digits of the reference numerals in the first embodiment.

In the acoustic apparatus shown in FIGS. 4A to 4C, when the diameter of the hole portion 491 of the ornament grille 409 is set to be small and close to the outer diameter of the open duct port 406, a noise elimination effect when an outlet airflow from the open duct port 406 passes through the ornament grille 409 is slightly greater than that in the first embodiment while the diameter remains the same. Other effects are the same as those in the first embodiment.

Third Embodiment

Figure 5A:
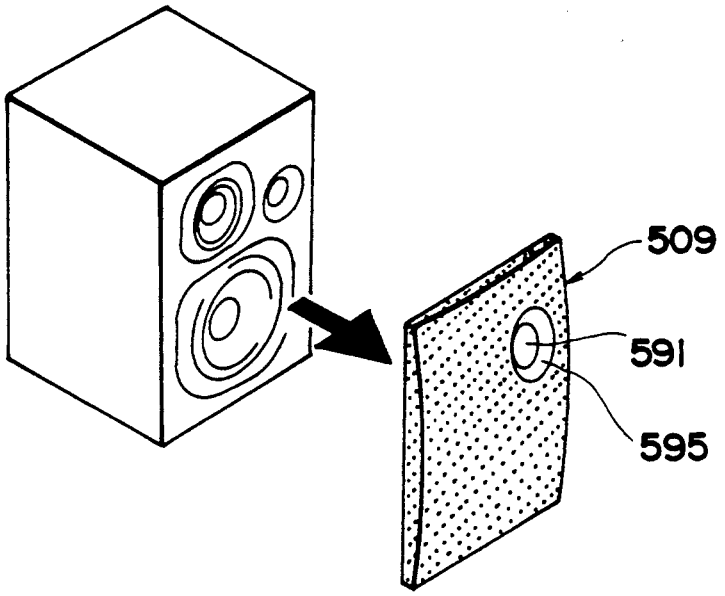
FIGS. 5A and 5B are respectively a perspective view of an acoustic apparatus according to a third embodiment, and an enlarged sectional view of the main part of the apparatus.
Figure 5B:
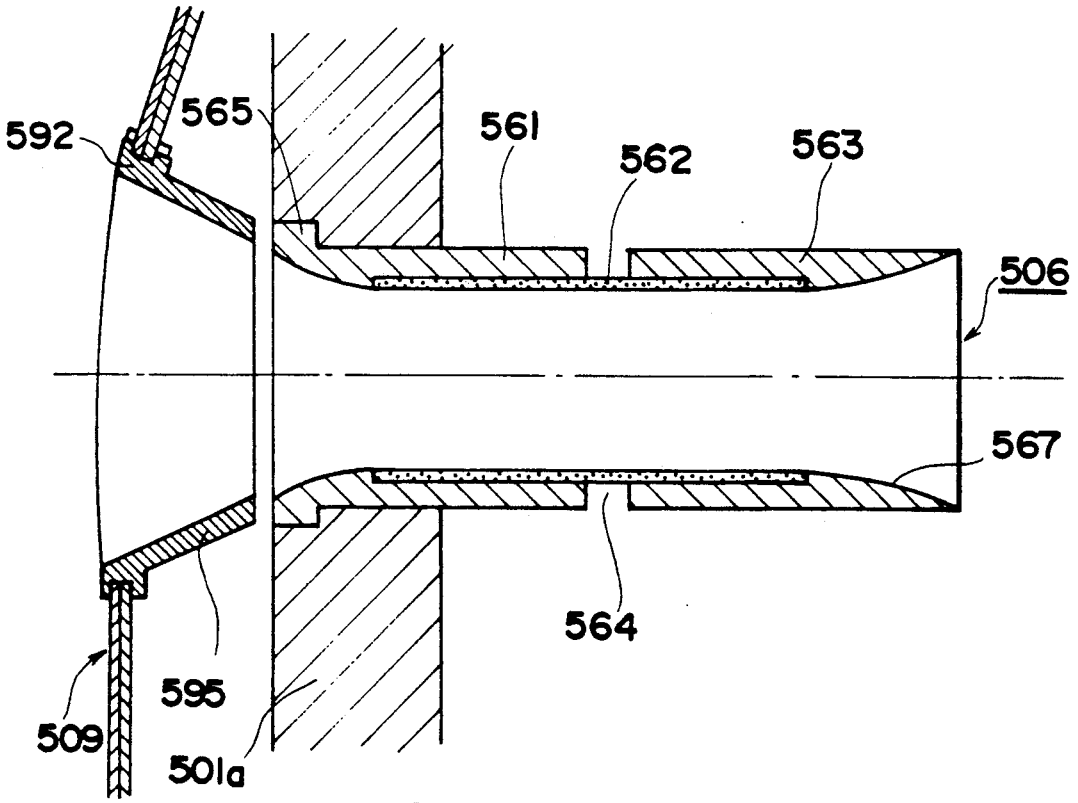

FIGS. 5A and 5B show a third embodiment of the present invention.

In the acoustic apparatus shown in FIGS. 5A and 5B, the shape of the escutecheon 392 of the ornament grille 309 in the first embodiment is modified. More specifically, a rear portion of a resin escutecheon extends backward to form a horn-like (or morning glory) guide 595 which is smoothly continuous with an R surface 566 of an outer cylinder 562. Note that an open duct port assembly 506 is the same as the open duct port assembly 306 shown in FIG. 3C.

It was expected that the acoustic apparatus shown in FIGS. 5A and 5B had a greater noise elimination effect since the diameter of a hole portion 591 is larger than that shown in FIGS. 4A to 4C. However, no significant difference from that shown in FIGS. 4A to 4C was observed in favor of the noise elimination effect.

Fourth & Fifth Embodiments

Figure 6A:
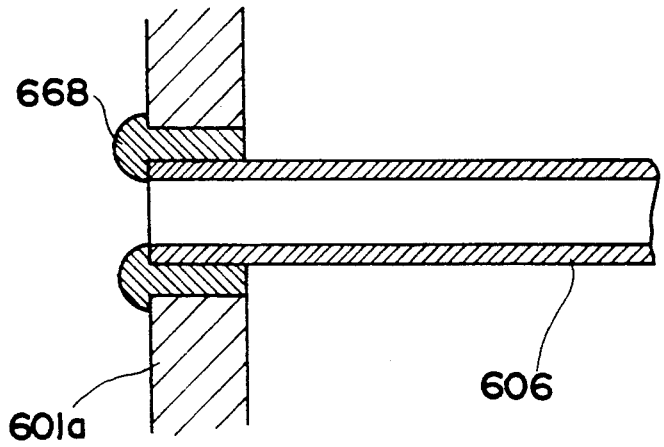
FIGS. 6A and 6B are sectional views of main parts fourth and fifth embodiments, respectively.
Figure 6B:
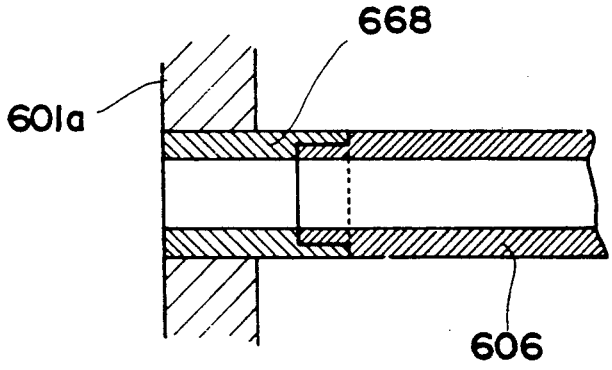
Figure 7A:
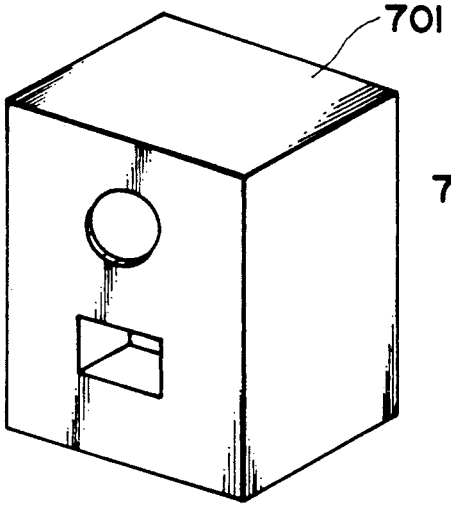
(Prior art) FIG. 7A
FIGS. 7A and 7B are respectively a perspective view and a sectional view showing an arrangement of a conventional bass-reflex speaker system.
Figure 7B:
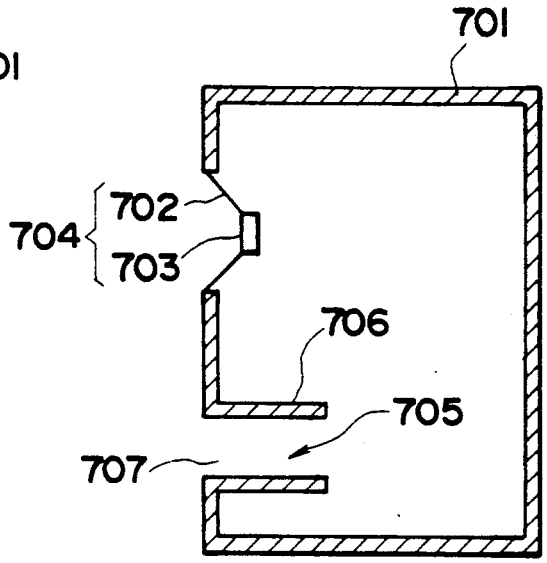
(Prior art) FIG. 7B
Figure 8:
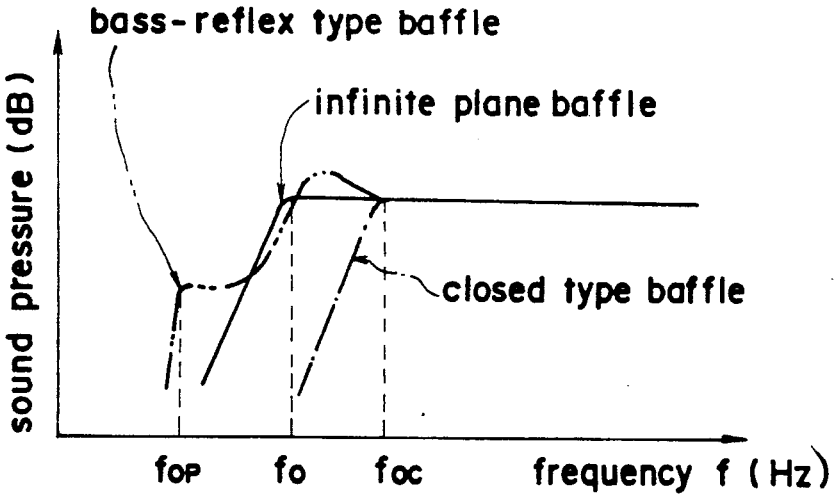
(Prior art) FIG. 8
FIG. 8 is a graph for explaining sound pressure characteristics of the speaker system shown in FIGS. 7A and 7B.

FIGS. 6A and 6B are sectional views of main parts of fourth and fifth embodiments of the present invention.

In FIGS. 6A and 6B, an open duct port 606 is formed of paper or resin like in the conventional system, or is formed of felt having air permeability and acoustic resistance. The open duct port 606 is attached to a baffle surface 601*a* of a cabinet through an ornament mounting member (escutecheon) 668 made of rubber. In these embodiments, transmission of derivative vibration of the open duct port 606 is prevented by the rubber escutecheon 668 as a viscoelastic member, and noise radiation from the cabinet can be eliminated. In addition, as in the above embodiments, an easy mounting operation can be assured due to tight clamping property by elastic deformation of the escutecheon 668, and an anti-vibration effect is not impaired even if the escutecheon 668, the open duct port 606, and the baffle surface 601*a* are adhered.

Modification of Embodiments

Note that the present invention is not limited to the above embodiments, and various changes and modifications may be made within the spirit and scope of the invention. In the first to third embodiments, as a material of the inner cylinders 361, 461, and 561, sponge, nonwoven fabric, and woven fabric having air permeability and acoustic resistance may be used in place of felt. As a material of the outer cylinders 362, 363, 462, 463, 562, and 563, a material other than rubber such as polyurethane, an urethane resin, or the like may be used in place of rubber if it has air permeability and a proper viscoelasticity. Furthermore, as a material of the escutecheons 392, 492, and 592, relatively hard rubber, or the like may be used. One of the paired outer cylinders 362 and 363, 462 and 463, or 562 and 563 may be a viscoelastic member having no air permeability. Since the viscoelastic member need only be attached, it need not be formed into a cylindrical shape in advance in the above embodiments, but may be formed by coating.

As a material of the viscoelastic member in the fourth and fifth embodiments, polyethyrene, an urethane resin, or the like may be used in place of rubber. As a material having air permeability and acoustic resistance, sponge, nonwoven fabric, woven fabric, and the like may be used in place of felt.

What is claimed is:

1. An acoustic apparatus comprising:

a Helmholtz resonator having an open duct port, and a vibrator which is arranged in the resonator and driven to cause the resonator to radiate a resonant acoustic wave, said open duct port comprising an air permeable member which has a given acoustic resistance and a viscoelastic member which has no air permeability and is attached to said air permeable member.

2. An apparatus according to claim 1, wherein said air permeable member is formed into a cylindrical shape, said viscoelastic member is disposed at front and rear portions of said cylindrical air permeable member, and a central portion of said cylindrical air permeable member is exposed as a portion of an outer peripheral wall of said open duct port.

3. An apparatus according to claim 1 or 2, wherein said vibrator is driven by an electrical servo to cancel an air counteraction from said resonator when said resonator is driven.

4. An apparatus according to claim 1, wherein said viscoelastics member of the open duct port functions as both a portion of the open duct port and a fixing member for fixing said open duct port and said cavity.

5. An apparatus according to claim 1, wherein at least one end of said open duct port is expanded in curvature to be made in a horn-like shape.

6. An apparatus according to claim 1, wherein the given acoustic resistance has a value which enables the air permeable member to serve as a sound absorption member on the inner surface of the open duct port and which prevents generation of duct resonance and wind noise.

7. An acoustic apparatus comprising:

a Helmholtz resonator having a cavity and an open duct port for causing said cavity to communicate with an external region, a vibrator which is arranged in the resonator and driven to cause the resonator to radiate a resonant acoustic wave, and a viscoelastic member inserted at a mounting portion between said open duct port and said cavity.

8. An apparatus according to claim 7, wherein said vibrator is driven by a electrical servo to cancel an air counteraction from said resonator when said resonator is driven.

* * * * *